US009534794B2

(12) United States Patent
Rogers et al.

(10) Patent No.: US 9,534,794 B2
(45) Date of Patent: Jan. 3, 2017

(54) CONVECTION COOKING APPLIANCE WITH CIRCULAR AIR FLOW SYSTEM

(75) Inventors: Paul Ross Rogers, Cleveland, TN (US); David Richard Sampson, Charlestown, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1301 days.

(21) Appl. No.: 12/404,581

(22) Filed: Mar. 16, 2009

(65) Prior Publication Data

US 2010/0229847 A1 Sep. 16, 2010

(51) Int. Cl.
*H05B 6/66* (2006.01)
*F24C 15/32* (2006.01)
*H05B 6/68* (2006.01)

(52) U.S. Cl.
CPC ..... *F24C 15/322* (2013.01); *H05B 6/68* (2013.01)

(58) Field of Classification Search
CPC ..... F24C 15/222; H05B 6/68
USPC 126/212, 21 A, 21 R; 219/10.55 B, 10.55 E, 219/400
See application file for complete search history.

(56) References Cited

U.S. PATENT DOCUMENTS 3,529,582 A 9/1970 Hurko et al.
3,978,843 A 9/1976 Durth
4,032,289 A * 6/1977 Johnson et al. ..... 432/200
4,357,522 A * 11/1982 Husslein et al. ..... 219/400
4,926,837 A 5/1990 Parker et al.
4,940,869 A 7/1990 Scholtes et al.
5,089,679 A * 2/1992 Eke ..... 219/680
5,468,935 A 11/1995 Wang
5,726,428 A * 3/1998 Christensen ..... 219/754
5,816,234 A 10/1998 Vasan
6,084,214 A * 7/2000 Tallman ..... B23K 1/012 219/388
6,615,819 B1 9/2003 Hernandez Burgos et al.
6,717,114 B2 4/2004 Austin et al.
6,872,926 B1 3/2005 Arntz et al.
6,904,903 B1 * 6/2005 Vroom ..... F24C 15/327 126/20
6,943,321 B2 9/2005 Carbone et al.
D524,600 S 7/2006 Austin et al.
7,094,998 B2 * 8/2006 Shozo et al. ..... 219/681
7,102,105 B2 9/2006 Oh
7,296,510 B2 11/2007 Ohtsuka et al.
7,329,838 B2 2/2008 Song et al.
7,368,683 B2 5/2008 Kim et al.
(Continued)

FOREIGN PATENT DOCUMENTS

EP 0443330 A2 8/1991
EP 0747638 A1 12/1996
(Continued)

*Primary Examiner* — Gregory Huson
*Assistant Examiner* — Nikhil Mashruwala

(57) ABSTRACT

A circular air flow pattern is created in a small oven cavity having a convection system including a convection cover which is mounted to and defines a duct in combination with a rear wall of the oven cavity. The convection cover includes an intake at one end portion arranged adjacent a first side wall of the oven cavity and a plurality of exhaust openings formed in another end portion arranged adjacent a second side wall of the oven cavity, with the convection cover progressively tapering through multiple sections. The rear wall can include an elongated recess over which the convection cover extends in forming the duct.

17 Claims, 4 Drawing Sheets

(56) References Cited

U.S. PATENT DOCUMENTS

| | | | | |
|---|---|---|---|---|
| 7,411,160 | B2 | 8/2008 | Duncan et al. | |
| 2006/0006163 | A1 | 1/2006 | Carbone et al. | |
| 2006/0289436 | A1 | 12/2006 | Carbone et al. | |
| 2007/0107712 | A1* | 5/2007 | Shiraichi et al. | 126/21 A |
| 2007/0145033 | A1 | 6/2007 | Kim et al. | |
| 2008/0190911 | A1 | 8/2008 | Adamski | |
| 2008/0202354 | A1 | 8/2008 | Lee et al. | |

FOREIGN PATENT DOCUMENTS

| | | | |
|---|---|---|---|
| EP | 0942235 | A1 | 9/1999 |
| GB | 2132338 | A | 7/1984 |
| JP | 58160744 | A | 9/1983 |
| JP | 60016243 | A | 1/1985 |
| JP | 6026650 | A | 2/1994 |
| JP | 8285285 | A | 11/1996 |

* cited by examiner

CONVECTION COOKING APPLIANCE WITH CIRCULAR AIR FLOW SYSTEM

BACKGROUND OF THE INVENTION

Field of the Invention

The present invention pertains to the art of cooking appliances and, more particularly, to a convection cooking system for an appliance having a small oven cavity.

Description of the Related Art

Conventional cooking appliances generally perform cooking operations through radiant heating developed from bake and/or broil elements. Such types of cooking appliances can take various forms, mainly ranges and wall ovens. While conventional or radiant heat cooking is suitable to a wide assortment of food types, the overall cooking process, especially baking, can be quite slow. The pre-heat time, combined with the cook time, is longer than most consumers desire.

Some radiant cooking appliances incorporate internal fans which can be used during certain cooking operations in order to generate an air flow within an oven cavity to enhance even cooking. Forced air convection allows for cooking at lower temperatures as compared to conventional radiant cooking processes. In addition, the forced air streams serve to disrupt a thermal insulation layer about the food item which increases the heat transfer rate between the food item and its surroundings, thereby reducing required cooking times.

In convection cooking appliances, the air flow can be designed to recirculate within the oven cavity, flow through the oven cavity and be exhausted, or a combination of both of these configurations. For obvious reasons, it is desirable to enhance the efficiency of any air flow system in order to reduce associated operating costs and minimize the required fan size, while still producing an effective air flow pattern and rate. Most convection systems employ a fan which draws cooking cavity air into a central intake portion and directs the air radially outward across a heating unit for re-introduction back into the oven cavity through plural, spaced exhaust outlets. Most often, the outlets are arranged either directly adjacent the side walls of the cooking cavity or the outlets are simply arranged in a generally circular configuration about the air inlet and angled toward the side walls. In either case, the air is exhausted along the side walls, flows forward towards a door for the oven cavity and then is re-directed into a central oven cavity region back to the fan intake.

With relatively large oven cavities, such as oven cavities of 4.0 cubic feet or more, the above-described air flow arrangement is quite effective. However, with smaller oven cavities in the order of 2.5 cubic feet or less, special spatial and air flow considerations are encountered. For instance, from just a dimensional standpoint, utilizing a conventional convection arrangement in a small oven cavity would result in the inlet and outlet portions being in close proximity which would tend to reduce the amount of air turnover inside the oven cavity. Therefore, regardless of the existence of numerous convection systems in the art, there exists a need for an enhanced convection air flow system for use in a cooking appliance, particularly a cooking appliance having a small oven cavity.

SUMMARY OF THE INVENTION

The present invention is directed to a cooking appliance including a convection system employing a convection cover used to establish a circular air flow pattern in an oven cavity, preferably a relatively small oven cavity. In accordance with the invention, a fan of the convection system is mounted behind the convection cover directly adjacent one side wall of the oven cavity. The convection cover has a first end portion formed with an air intake exposed to an inlet of the fan and tapers across a rear wall of the oven cavity, preferably through multiple, progressively tapering sections, to a second end portion directly adjacent an opposing side wall. At the second end portion, the convection cover is provided with a plurality of spaced air outlets or exhausts.

The cover is mounted to a rear wall oven the oven cavity, while also being spaced from the rear wall to define, in combination with the rear wall, a duct extending across the rear wall from the intake to the exhausts. The cover is constructed such that the intake is defined by at least one opening arranged to draw air into the fan at only one side of the oven cavity, while a plurality of small exhaust openings are provided at the other side of the oven cavity. With this arrangement, the air is forced to follow a circular air flow pattern or loop around the interior of the oven cavity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENT

Figure 1:
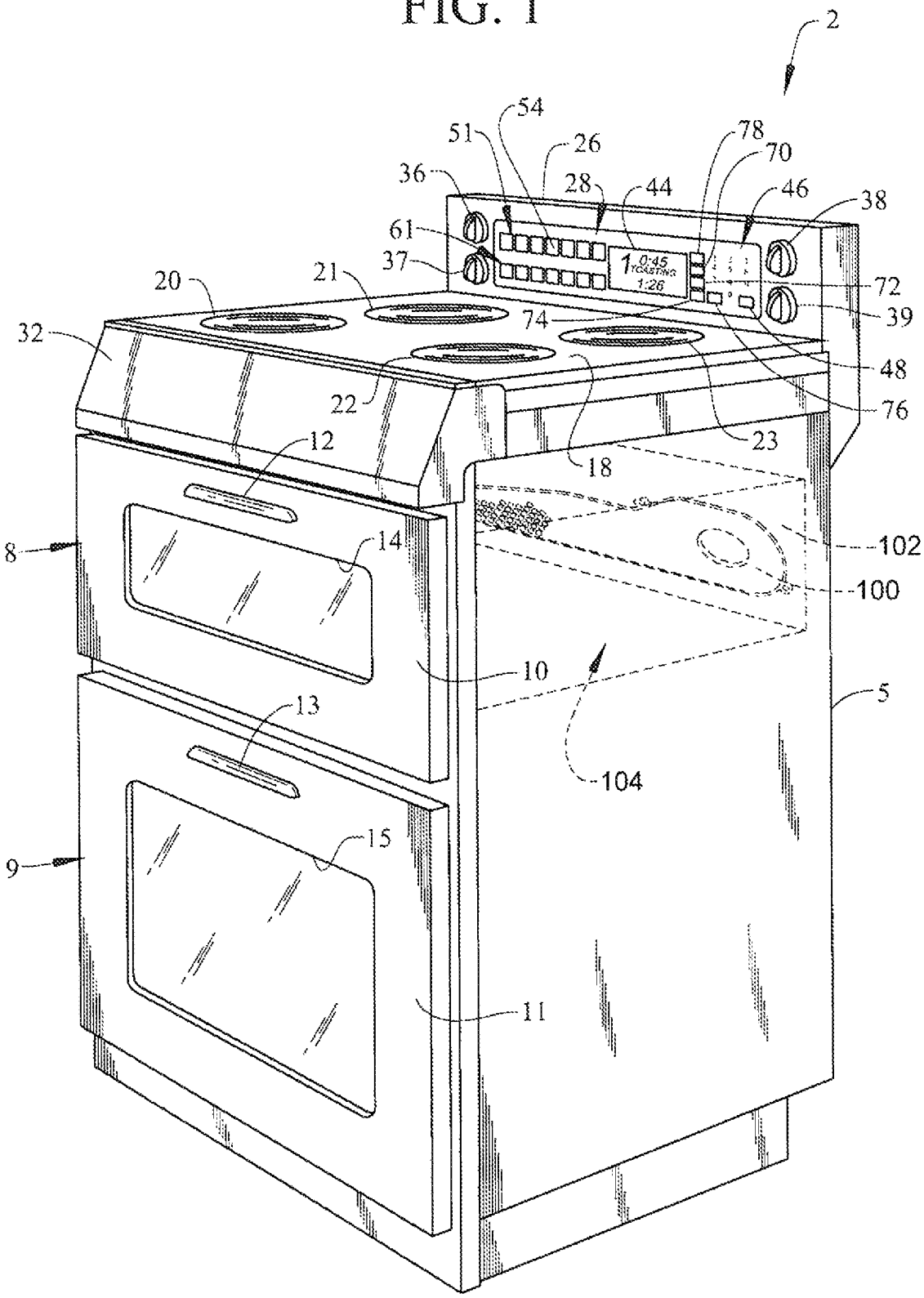
FIG. 1 is a perspective view of a slide-in double oven range-type cooking appliance incorporating the convection air flow system of the present invention.

With initial reference to FIG. 1, the invention is illustrated for use in connection with an electric range generally indicated at 2. In the embodiment shown, electric range 2 includes a cabinet 5 within which is arranged a first or upper oven 8 and a second or lower oven 9. Upper and lower ovens 8 and 9 have associated doors 10 and 11 which are respectively provided with handles 12 and 13 that can be used to pivot doors 10 and 11 in order to access respective cooking chambers or cavities of ovens 8 and 9. For the sake of completeness, this figure illustrates doors 10 and 11 with respective viewing windows 14 and 15.

Cabinet 5 is also provided with an associated range top 18 which supports various spaced surface heating elements 20-23 in a manner known in the art. At an upper rear portion, cabinet 5 includes an upstanding portion 26 which is provided with a control panel 28. At this point, it should be realized that the arrangement and location of control panel 28 could vary in accordance with the present invention. For example, control panel 28 could be located along an upper face panel 32 of cabinet 5. In any event, upstanding portion 26 includes a plurality of knobs 36-39 for use in selectively activating and deactivating surface heating elements 20-23 respectively. Control panel 28 is preferably arranged between knobs 36-39 and is shown to include a substantially central display 44, such as an LED, LCD or VFD display unit. Furthermore, control panel 28 is provided with a number pad generally indicated at 46 that has an associated button 48 for use in setting a clock arranged either within display 44 or in another portion of control panel 28.

As also known in the art and shown in this figure, control panel 28 of range 2 includes a first row of control buttons generally indicated at 51 which are generally used to establish an operational mode for upper oven 8. Although not separately labeled, first row 51 preferably includes cancel, bake, broil, convection cooking, cleaning mode, toasting and warming mode control members shown in the form of buttons, such as button 54 for convection cooking. In a generally similar manner, a second row of control buttons 61 are provided for lower oven 9. In the most preferred form of the invention, second row 61 includes cancel, bake, broil, cleaning mode, and light control members, preferably in the form of individual buttons. In the most preferred form of the invention, the user is able to program the operation of at least upper and lower ovens 8 and 9 through the use of the first and second rows of buttons 51 and 61, along with numeric pad 46, timer buttons 70 and 72, cook time and stop time buttons 74 and 76, and an auto set button 78. Since this basic programming arrangement is known in the art as exemplified by U.S. Pat. No. 6,255,630, which is incorporated herein by reference, and not considered part of the present invention, it will not be described further here in detail. Instead, with reference to this illustrative embodiment, the inclusion of a convection mode, either operated alone or in combination with any of the other cooking modes, is of concern with respect to the present invention and, more particularly, the air flow system employed with the convection cooking, including a convection cover as indicated at 100 mounted to a back wall 102 of oven cavity 104 for oven 8 as detailed below.

Figure 2:
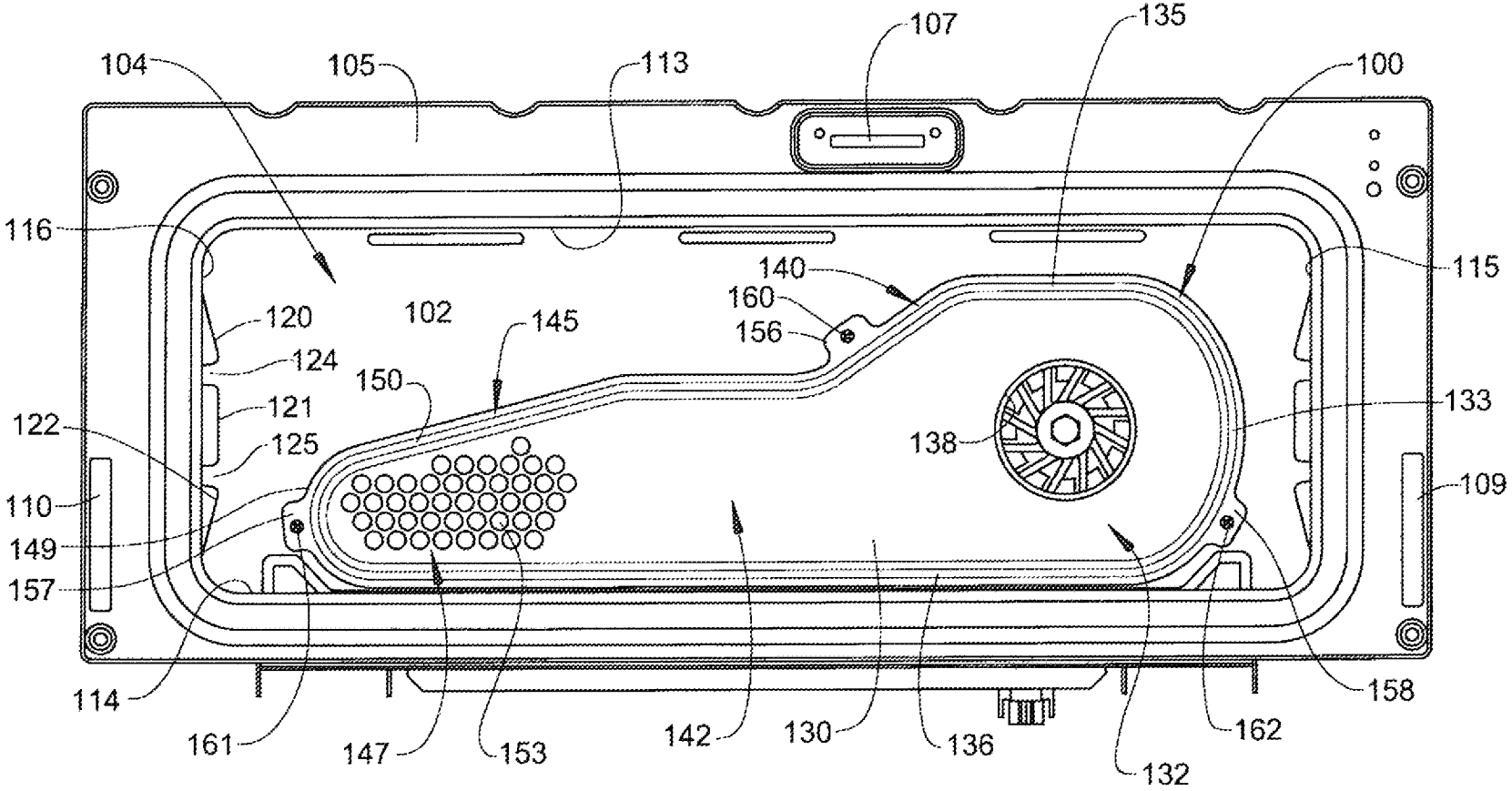
FIG. 2 is a front elevational view of an oven cavity of the cooking appliance of FIG. 1 incorporating the convection air flow system.

With reference to FIG. 2, certain structure establishing oven cavity 104 behind door 10 is depicted. In particular, there is shown a face plate 105 that is secured to cabinet 5. Face plate 105 includes an upper latch slot 107 and side hinge arm slots 109, 110. Although not shown or considered part of the present invention, upper latch slot 107 is used in combination with a lock that is particularly employed when oven 8 is used in the cleaning mode. In addition, side hinge arm slots 109 and 110 receive arms (not shown) associated with pivotally attaching door 10. In any case, upper oven 8 includes internal oven cavity 104 which is defined by back or rear wall 102, as well as top, bottom and opposing side walls 113-116 respectively. Formed on each of side walls 115 and 116 are a plurality of vertically spaced rack support members 120-122 which define upper and lower rack receiving recesses 124 and 125.

Figure 3:
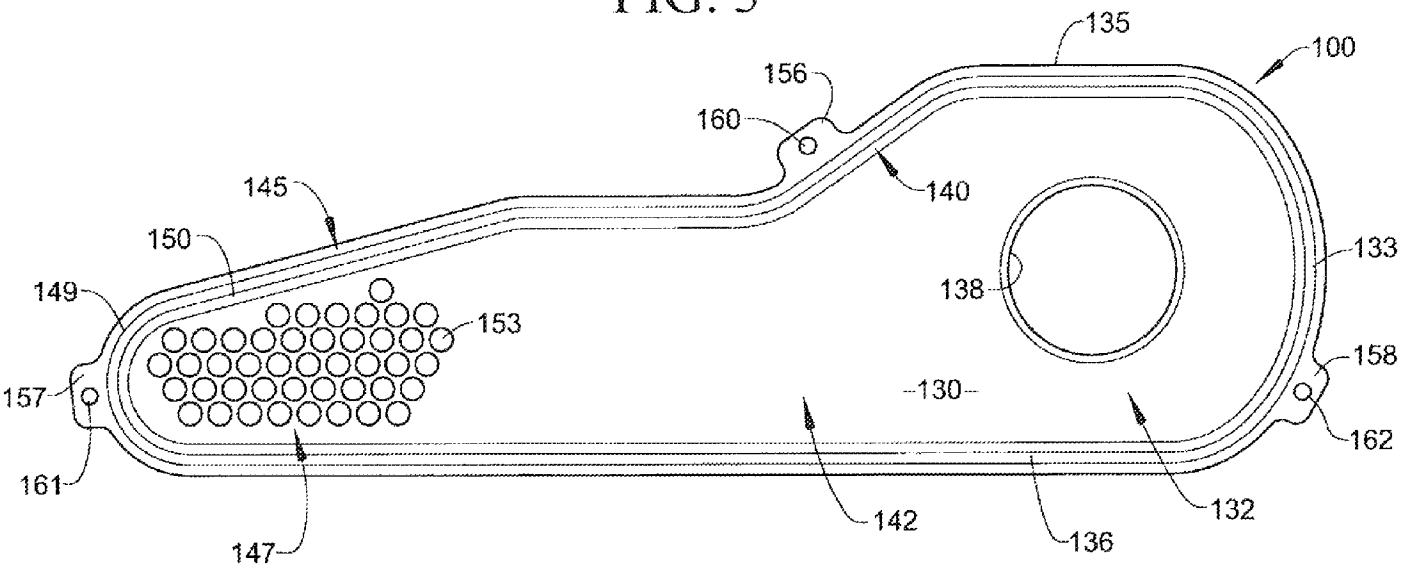
FIG. 3 is an enlarged front view of a convection cover employed in the invention.
Figure 4:
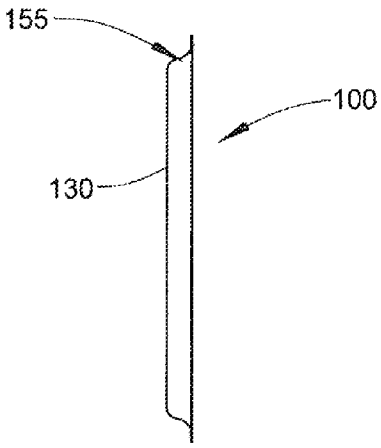
FIG. 4 is side view of the convection cover of FIG. 3.

More important to the present invention, as depicted in FIGS. 2-4, convection cover 100 is shown to include a main face plate 130 having a first end portion 132 defined, at least in part, by an arcuate end 133, a substantially horizontal top portion 135 and substantially horizontal bottom portion 136. Formed in main face plate 130 at first end portion 132 is a central enlarged opening or intake 138. From first end portion 132, convection cover 100 goes through a first tapered section 140 which leads to an intermediate portion 142. From intermediate portion 142, convection cover 100 goes through a second tapered section 145 which leads to a second end portion 147. Second end portion 147 is also preferably defined by an arcuate end 149, substantially horizontal bottom portion 136 and a tapered upper wall portion 150 as clearly illustrated in these figures. At second end portion 147, convection cover 100 is provided with a plurality of spaced outlet openings or exhausts 153. Provided about a curved perimeter 155 (FIG. 4) of convection cover 100 is provided various tabs 156-158, each of which has an associated mounting opening 160-162, for use in securing convection cover 100 to rear wall 102 as will be discussed more fully below.

At this point, as perhaps best illustrated in FIG. 2, it should be recognized that convection cover 100 spans substantially entirely across rear wall 102 of oven 8. More specifically, first and second end portions 132 and 147 are substantially equally spaced from side walls 115 and 116 by only a relatively small percentage of the overall width of oven cavity 104. In the most preferred form of the invention, convection cover 100 spans at least 75%, and preferably 80% or more, of the overall width of oven cavity 104. In addition, first end portion 132 spans a height distance in the same preferred ranges. On the other hand, due to the inclusion of first and second tapered sections 140 and 145, second end portion 147 only spans from about 35% to up to 55% of a height of oven cavity 104. In addition, intake 138, which is preferably circular as shown, has a center which is preferably located just below a horizontal centerline (not shown) between top and bottom walls 113 and 114, while each of the plurality of outlet openings 153 are preferably arranged below the centerline.

Figure 5:
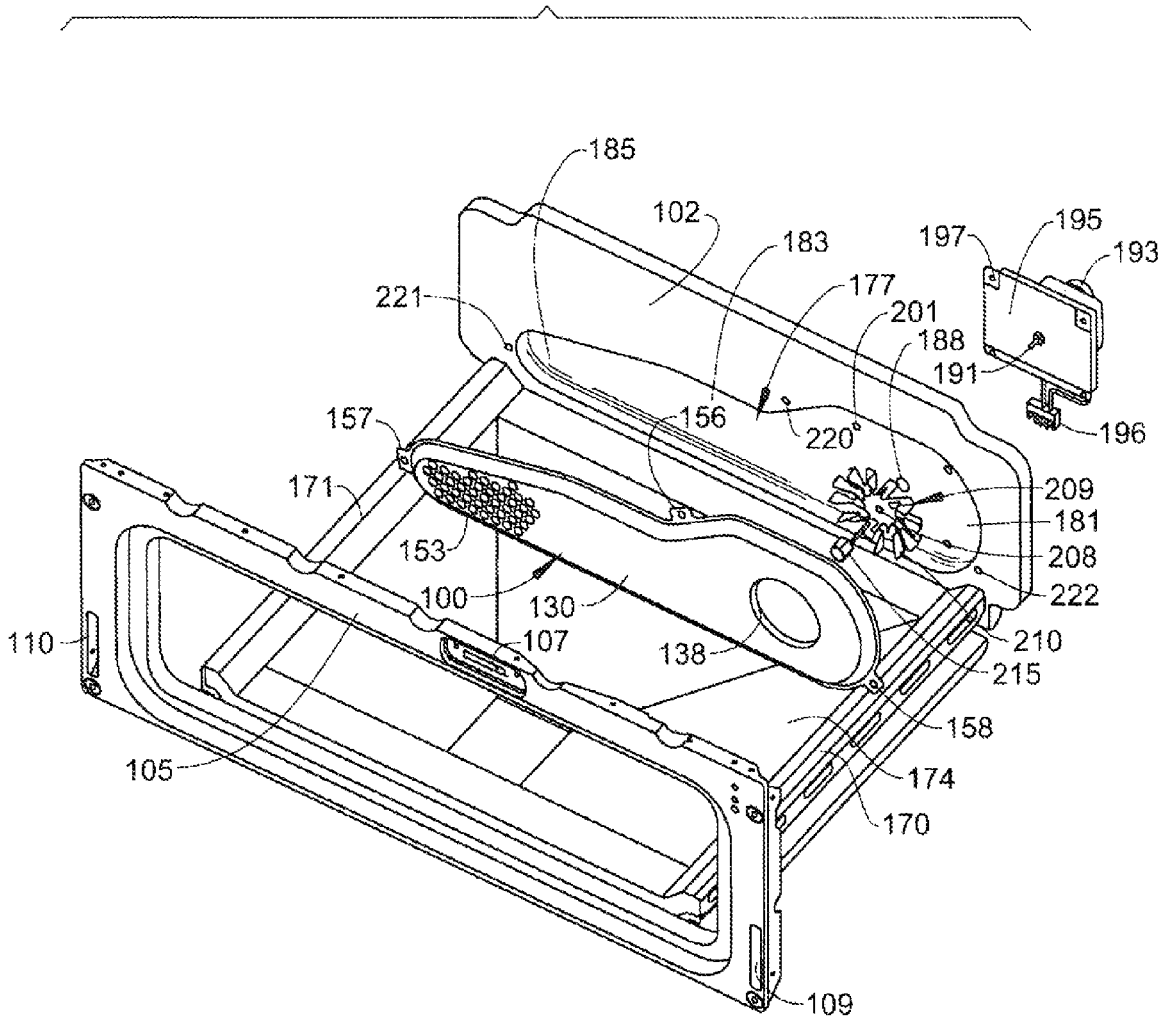
FIG. 5 is an exploded view of the overall convection air flow system of the invention.

As depicted in FIG. 5, oven cavity 104 has associated therewith a pair of lower side supports 170 and 171, as well as a bottom tray 174. More importantly, rear wall 102 is shown to be formed with a recessed section 177 having an enlarged first end portion 181, an intermediate portion 183 and a tapered second end portion 185. Provided in enlarged first end portion 181 is an opening 188 through which extends a drive shaft 191 of a motor 193, which is preferably operable in multiple or variable speeds. Motor 193 is secured to a mounting plate 195 and has extending therefrom an associated electrical connector 196. Mounting plate 195 includes a plurality of holes, one of which is indicated at 197, which are adapted to align with apertures, one of which is indicated at 201, provided in recessed section 177. More specifically, holes 197 are aligned with apertures 201 and receive respective fasteners (not shown) for securing mounting plate 105 to rear wall 102. At the same time, drive shaft 191 extends through opening 188, as well as a central through hole 208 provided in a fan 209 having blades 210. A connector 215 is then attached to drive shaft 191. Although not clearly illustrated, it should be recognized that drive shaft 191 is keyed or otherwise secured to fan 209 such that operation of motor 193 causes fan 209 to rotate directly adjacent rear wall 102. Also shown in this figure, rear wall 102 is provided with a plurality of spaced mounting holes 220-222 which align with mounting openings 160-162 of tabs 156-158 for use in securing convection cover 100 to rear wall 102 about recessed section 177, with first end portion 132 being arranged adjacent side wall 115 and second end portion 147 being arranged adjacent side wall 116.

With convection cover 100 mounted in the manner discussed above, fan 209 is arranged behind intake 138 such that activation of motor 193 causes air to be drawn into intake 138 and propelled radially outwardly from fan 209 toward second end portion 147 and outlet openings 153. In accordance with the invention, at a minimum, the configuration of convection cover 100 establishes a duct, in combination with rear wall 102, for this airflow. In the preferred embodiment shown, recessed section 177 accommodates fan 209 and further establishes a portion of this duct. That is, at this point, it should be recognized that the invention can be employed without recessed section 177, thereby establishing the required airflow duct based solely on the construction of convection cover 100 in combination with rear wall 102. However, with the inclusion of recessed section 177, the thickness or depth of convection cover 100 can be reduced without sacrificing the volumetric airflow capacity of the overall system. To this end, recessed section 177 is preferably formed in rear wall 102, such as through a stamping operation. In any case, during operation of the overall convection system, air is drawn into central opening 138 at one side portion of oven cavity 104, forced behind convection cover 100 to outlet openings 153 at a second side portion of the oven cavity 104. Due to these spaced locations, the airflow in the overall oven cavity 104 will be forced to flow forward from adjacent side wall 116 towards door 10, then along door 10 to adjacent second side wall 115 and back toward central opening 138. To this end, convection cover 100 is constructed such that the central intake 138 is arranged to draw air into fan 209 at only one side of oven cavity 104, while the plurality of small exhaust openings 153 are provided at the other side of oven cavity 104 such that the overall arrangement forces the air to follow a single, circular airflow pattern or loop around the interior of oven cavity 104. This overall configuration is seen to be particularly important with the reduced sized oven cavity of the invention which generally has a volume in the order of 2.5 cubic feet or less. By providing one or more tapered sections associated with convection cover 100, particularly tapered sections 140 and 145, the pressure and flow rate of the airflow is optimized in order to ensure an effective circular airflow pattern throughout oven cavity 104.

Although described with reference to a preferred embodiment of the invention, it should be readily understood that various changes and/or modifications can be made to the invention without departing from the spirit thereof. For instance, although the invention has been described with respect to an electric cooking appliance, it should be readily understood that the invention could be readily applied in connection with other heat sources, including natural or propane gas sources. In addition, although the invention has been described with reference to a range having a upper and lower ovens, the invention can also be employed in connection with other types of ovens, including wall ovens having reduced oven cavity sizes which provide for quicker heating and cooking times. Furthermore, although not shown or described, it should be readily recognized that the oven includes bake and broil heating elements which are used in combination with the convection airflow system of the invention. In general, the invention is only intended to be limited by the scope of the following claims.

What is claimed is:

1. A cooking appliance incorporating a convection cooking system comprising:

an oven cavity defined by interconnected top, bottom, rear and first and second, opposing side walls, with the rear wall extending from the bottom wall to the top wall and defining an overall height of the oven cavity;

a door mounted for selectively providing access to the oven cavity;

a control panel having a plurality of control elements for selecting a desired cooking operation including a convection cooking mode; and a convection cooking system including a fan positioned inside the oven cavity directly adjacent the rear wall, a motor having a drive shaft drivingly coupled to the fan such that operation of the motor causes the fan to rotate, and a convection cover having a first end portion, an intermediate portion and a second end portion, and multiple tapered sections with a first tapered section between the first end portion and the intermediate portion and a second tapered section between the intermediate portion and the second end portion, said convection cover being arranged in the oven cavity and mounted to the rear wall to form a tapered duct therebetween, with the first end portion of the convection cover being adjacent the first side wall and the second end portion of the convection cover being adjacent the second side wall such that the convection cover spans at least a majority of the rear wall of the oven cavity and the first end portion spans at least 75% of the overall height of the oven cavity and the second end portion narrows relative to the first end portion to span less than 55% of the overall height of the oven cavity, said convection cover being formed with an intake in the first end portion at which the fan is mounted and a plurality of exhaust ports in the second end portion wherein, during operation of the fan, an airflow from along the first side wall of the oven cavity is drawn into the duct at the intake and forcibly directed through the intermediate portion to the second end portion of the convection cover, out of the duct through the plurality of exhaust ports, along the second side wall towards the door, across the door toward the first side wall and back to the intake, thereby establishing a single, circular effective convection airflow pattern through the oven cavity.

2. The cooking appliance according to claim 1, wherein the oven cavity is in the order of approximately 2.5 cubic feet or less.

3. The cooking appliance according to claim 1, further comprising: a plurality of tabs arranged at spaced locations about a periphery of the convection cover, said convection cover being secured to the rear wall at the plurality of tabs.

4. The cooking appliance according to claim 1, wherein the first end portion of the convection cover is spaced from the first side wall approximately equal to a spacing of the second end portion of the convection cover from the second side wall.

5. The cooking appliance according to claim 1, wherein the convection cover spans at least 75% of an overall width of the oven cavity.

6. The cooking appliance according to claim 5, wherein the convection cover spans 80% or more of the overall width of the oven cavity.

7. The cooking appliance according to claim 1, wherein the oven cavity has an associated, horizontal centerline between the top and bottom walls, and wherein a majority of said plurality of exhaust ports are located below the centerline.

8. The cooking appliance according to claim 7, wherein all of the plurality of exhaust ports are located below the horizontal centerline.

9. The cooking appliance according to claim 7, wherein the intake has an associated center which is located below the horizontal centerline.

10. The cooking appliance according to claim 1, wherein a lower peripheral wall portion of the convection cover extends substantially parallel to the bottom wall and each of the first and second tapered sections are formed in an upper peripheral wall portion of the convection cover.

11. The cooking appliance according to claim 1, wherein each of the first and second end portions are arcuate adjacent the first and second opposing side walls respectively.

12. The cooking appliance according to claim 1, further comprising: a recessed section formed in the rear wall, said convection cover extending over the recessed section such that the recessed section defines part of the duct.

13. The cooking appliance according to claim 12, wherein the recessed section spans across a majority of the rear wall.

14. The cooking appliance according to claim 1, wherein the second end portion only spans about 55% of the overall height of the oven cavity.

15. The cooking appliance according to claim 14, wherein the second end portion only spans about 35% of the overall height of the oven cavity.

16. The cooking appliance according to claim 15, wherein the first end portion spans 75% of the overall height of the oven cavity.

17. The cooking appliance according to claim 1, wherein the rear wall includes a recessed section within which the fan is positioned.

* * * * *